US005760803A

United States Patent [19]

Yamamoto et al.

[11] Patent Number: 5,760,803

[45] Date of Patent: Jun. 2, 1998

[54] INK JET RECORDING TRANSFER MOLDING PROCESSES FOR FORMING AN INK JET RECORDING HEAD AND A RECORDING APPARATUS USING THE HEADS

[75] Inventors: Hisashi Yamamoto, Machida; Yukio Kawajiri; Makoto Shibata, both of Yokohama; Shuji Koyama, Kawasaki; Manabu Sueoka, Yokohama; Toshio Suzuki, Inagi; Takumi Suzuki, Yokohama, all of Japan

[73] Assignee: Canon Kabushiki Kaisha, Tokyo, Japan

[21] Appl. No.: 948,493

[22] Filed: Sep. 22, 1992

[30] Foreign Application Priority Data

Sep. 24, 1991 [JP] Japan ..... 3-243421

[51] Int. Cl.[6] ..... B41J 2/01

[52] U.S. Cl. ..... 347/47; 156/242; 156/244.11; 156/244.19; 156/244.24; 347/65

[58] Field of Search ..... 346/1.1, 75, 140 R; 156/647, 242, 244.11, 244.19, 244.24, 244.25; 427/387, 412.1, 412.5; 347/42, 56, 63, 64, 65, 47

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,509,063 | 4/1985 | Sugitani et al. | 347/65 |
| 4,536,250 | 8/1985 | Ikeda et al. | 347/56 X |
| 4,558,333 | 12/1985 | Sugitani et al. | 347/65 |
| 4,657,631 | 4/1987 | Noguchi | 156/272.2 X |
| 4,720,716 | 1/1988 | Ikeda et al. | 347/64 |
| 4,723,129 | 2/1988 | Endo et al. | 347/45 |
| 4,725,859 | 2/1988 | Shibata et al. | 347/58 |
| 4,727,012 | 2/1988 | Quella et al. | 347/68 X |
| 4,740,796 | 4/1988 | Endo et al. | 347/56 |
| 4,774,530 | 9/1988 | Hawkins | 347/63 |
| 4,899,181 | 2/1990 | Hawkins et al. | 347/63 |
| 5,010,356 | 4/1991 | Albinson | 347/45 |
| 5,218,754 | 6/1993 | Rangappan | 347/42 |
| 5,334,999 | 8/1994 | Kashiwazaki et al. | 347/65 |

FOREIGN PATENT DOCUMENTS

| | | | |
|---|---|---|---|
| 0350953 | 1/1990 | European Pat. Off. . | |
| 0445688 | 9/1991 | European Pat. Off. . | |
| 54-056847 | 5/1979 | Japan . | |
| 55-87573 | 7/1980 | Japan | 347/63 |
| 55-118877 | 9/1980 | Japan | 347/63 |
| 59-123670 | 7/1984 | Japan . | |
| 59-138461 | 8/1984 | Japan . | |
| 60-071260 | 4/1985 | Japan . | |

OTHER PUBLICATIONS

Hewlett–Packard Journal, Bhaskar, et al., "Development of the Thin–Film Structure for the ThinkJet Printhead", vol. 36, No. 5, pp. 27–33, May 1985.

Polymer Journal, Fréchet et al., "Thermally Depolymerizable Polycarbonates V. Acid Catalyzed Thermolysis of Allylic and Benzylic Polycarbonates: A New Route to Resist Imaging", vol. 19, No. 1, pp. 31–49, 1987.

*Primary Examiner*—John E. Barlow, Jr.

*Attorney, Agent, or Firm*—Fitzpatrick, Cella, Harper & Scinto

[57] ABSTRACT

An ink jet recording apparatus includes a recording head having plural discharge openings for discharging ink, a liquid chamber for storing the ink to be supplied to the discharge openings, a liquid flow path for communicating the discharge openings with the liquid chamber, and plural energy generating elements for generating energy to be used for discharging the ink from the discharge openings. The head also includes a substrate having the energy generating elements provided thereon and a transfer molded structural member made of thermosetting resin. The structural member has a concave portion for forming a liquid flow path, and the structural member is fused to the substrate.

4 Claims, 11 Drawing Sheets

INK JET RECORDING TRANSFER MOLDING PROCESSES FOR FORMING AN INK JET RECORDING HEAD AND A RECORDING APPARATUS USING THE HEADS

BACKGROUND OF THE INVENTION

1. Field of the Invention

The present invention relates to an ink jet recording head which is fabricated by the use of the transfer molding.

Conventionally, attempts of using the transfer molding have been made to fabricate an ink jet recording head (thereinafter referred to as "recording head"), a typical example of which is shown in FIG. 4. In the following, the recording head of FIG. 4 as well as its fabrication method will be described.

First, a removable solid layer (not shown) is formed on a region corresponding to discharge ports 154, liquid channels 155 and a liquid chamber 156 on an element plane of a substrate 151 having energy generating elements 158 provided thereon. Next, by the transfer molding, a structural member 153 is molded on the solid layer and the element plane of the substrate 151. Then, the structural member 153 is fused on to the element plane of the substrate 151 at the same time with the molding. By removing the solid layer, the discharge ports 154, the liquid channels 155 and the liquid chamber 156 are formed.

However, the conventional recording head as above described had a problem that the substrate and the structural member might be peeled off at the transfer molding of the structural member, because the fusion (adhesion) of the structural member with the substrate was poor.

In particular, it had a problem that when a plurality of recording heads were integrally molded, and thereafter cut off at predetermined positions to obtain the plurality of recording heads, the substrate and the structural member might be peeled off due to vibration at the cutting, possibly cracking the substrate.

SUMMARY OF THE INVENTION

An object of the present invention is to provide an ink jet recording head having an excellent adhesion between the structural member and the substrate, and which is less affected by the vibration at the cutting.

Another object of the present invention is to provide an ink jet recording head having discharge ports for discharging the ink, a liquid chamber for reserving the ink to be supplied to the discharge ports, liquid channels for communicating the discharge ports to the liquid chamber, and energy generating elements, provided on the liquid channels, for generating the energy for use to discharge the ink through the discharge ports, characterized in that a substrate having the element plane provided with the energy generating elements and a structural member which is molded together with the substrate by the transfer molding are fused via an adherent layer having cushioning for improving the adhesion between the substrate and the structural member, and on a plane of the structural member opposed to the substrate, groove portions for constituting the liquid channels are formed corresponding to positions of the energy generating elements, and a void portion for constituting the liquid chamber communicating to the groove portions, which has the element plane of the substrate as a bottom wall, is formed.

The adherent layer is preferably a polyimide resin layer. Further, the energy generating element is preferably an electricity-heat converter for generating the heat energy for use in discharging the ink. The recording head is preferably a full-line type in which discharge ports are formed over an entire width of recording region.

Since the substrate and the structural member for constituting the discharge ports, the liquid channels and the liquid chamber are fused via the adherent layer provided on a region corresponding to an interface between the substrate and the structural member, the adhesion between the substrate and the structural member is improved, resulting in less exfoliation of the structural member from the substrate which may occur when the structural member is transfer molded on the substrate.

Further, since the adherent layer has also the cushioning, when a plurality of ink jet recording heads are molded integrally by the transfer molding, and after the molding, are cut off into individual ink jet recording heads, the vibration at the cutting can be absorbed by the adherent layer, resulting in less occurrence of cracks in the substrate due to the vibration.

BRIEF DESCRIPTION OF THE DRAWINGS

FIGS. 8A to 8F are views for explaining a manufacturing method according to one embodiment of an ink jet recording head, wherein FIG. 8A is a typical perspective view showing a substrate, FIG. 8B is a typical perspective view showing the substrate provided with a solid layer, FIG. 8C is a cross-sectional view of essential parts for a mold useful in molding a structural member, FIG. 8D is a typical plan view showing the structural member after releasing the mold, FIG. 8E is a cross-sectional view taken along the line E—E' of D, and FIG. 8F is a cross-sectional view taken along the line E—E' of D after removing the solid layer.

FIGS. 9A to 9D are views for explaining a manufacturing method according to another embodiment of an ink jet recording head, wherein FIG. 9A is a typical perspective view showing a substrate, FIG. 9B is a typical perspective view showing the substrate provided with a solid layer, FIG. 9C is a cross-sectional view of essential parts for a mold useful in molding a structural member, and FIG. 9D is a cross-sectional view of essential parts for a mold useful in molding the structural member after releasing the mold.

FIGS. 10A and 10B are views for explaining a manufacturing method according to another embodiment of an ink jet recording head, wherein FIG. 10A is a plan view thereof, and FIG. 10B is a cross-sectional view thereof cut off at the discharge port forming line of A—A.

DETAILED DESCRIPTION OF THE PREFERRED EMBODIMENTS

The embodiments of the present invention will be described below based on the drawings.

First, a first embodiment of an ink jet recording head (thereinafter referred to as "recording head") will be described.

Figure 5:
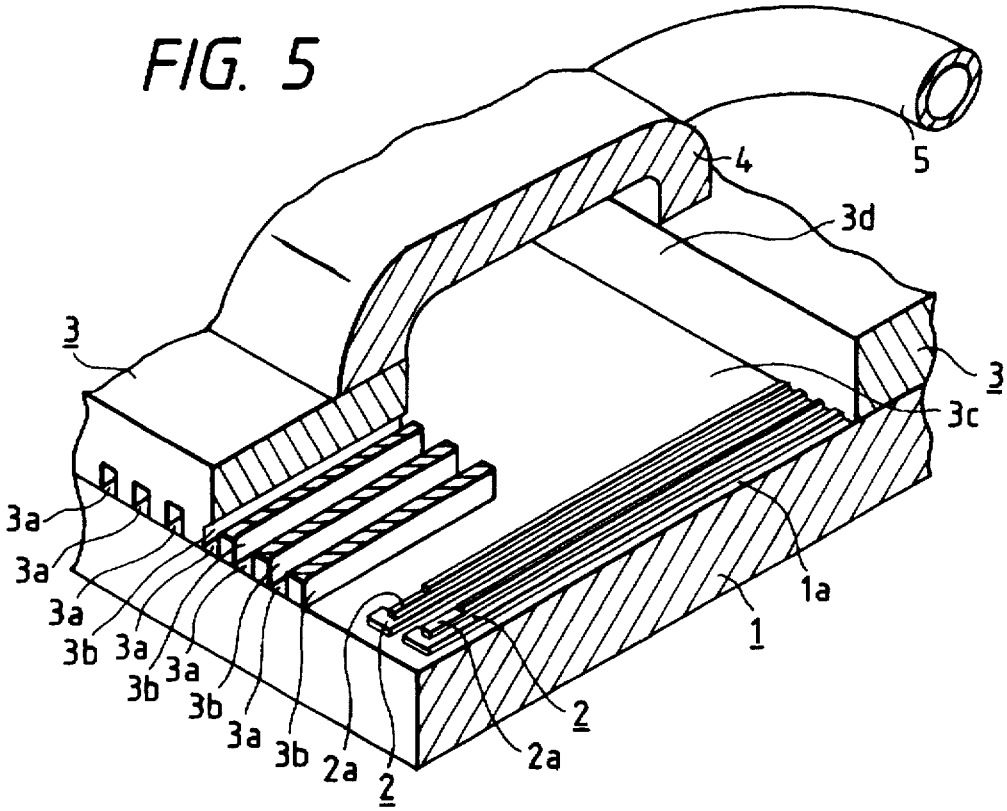
FIG. 5 is a perspective view, partially broken away, showing an ink jet recording head according to an embodiment of the present invention.

FIG. 5 is a perspective view, partially broken away, showing the constitution of the recording head. In the same figure, a plurality of electrodes 2 connected with heating portions of electricity-heat converters 2*a* (e.g., $HfB_2$+Al+$SiO_2$+Ta) are formed as the film in a semiconductor manufacturing process, such as etching, vapor deposition or sputtering, and arranged at predetermined spacings on one surface of a substrate 1 made of glass, semiconductor (silicone wafer), ceramic, plastic or metal, this one surface being an element surface 1*a*. Also, on the element surface 1*a*, a structural member 3 of one piece member made of a thermosetting resin such as epoxy resin or silicone resin is fused thereto at the same time with the molding by the transfer molding.

On a face of the structural member 3 opposed to the element surface 1*a*, a plurality of groove portions are formed corresponding to respective positions of heating portions of electricity-heat converters 2*a*, with the space surrounded by each groove portion and the element surface 1*a* constituting a liquid channel 3*b*, and an opening from each space constituting a discharge port 3*a*. Also, the structural member 3 is formed with a void portion communicating to the groove portions (liquid channels 3*b*) and having the element surface 1*a* as a bottom wall, thereby constituting a liquid chamber 3*c*, and moreover, an opening for communicating the void portion (liquid chamber 3*c*) to the outside (such as a connector 4 as described thereafter) is opened toward the same direction as that toward which the element surface 1*a* faces to provide a supply port 3*d*. The supply port 3*d* is connected via the connector 4 with a supply tube 5 connected to an ink tank (not shown), the ink being supplied from the ink tank through the supply tube 3*d* to the liquid chamber 3*c*.

Herein, the operation in discharging the ink through discharge ports 3*a* will be described. The ink supplied to the liquid chamber 3*c* enters the liquid channels 3*b* with a capillary action, forming a meniscus at each discharge port 3*a* and keeping each liquid channel 3*b* filled with the ink. Then, the heating portions of electricity-heat converters 2*a* are energized via the electrodes 2 and heated, causing the ink on the heating portions of the electricity-heat converters 2*a* to be rapidly heated and produce bubbles within the liquid channels 3*b*, so that the ink is discharged through the discharge ports 3*a* based on the creation of bubbles.

Though an example of the energy generating element for generating the energy for use in discharging the ink was the electricity-heat converter 2*a* herein, the invention is not limited to such a form, but it should be noted that a piezoelectric element for generating the mechanical energy acting to instantly apply the discharge pressure onto the ink may be used. Also, the discharge ports 3*a* can be formed at a high density of 16 ports/mm, with a total of 128 or 256 ports, and further can be made the full-line type by forming them across the entire width of recording area of a recording medium.

Figure 6:
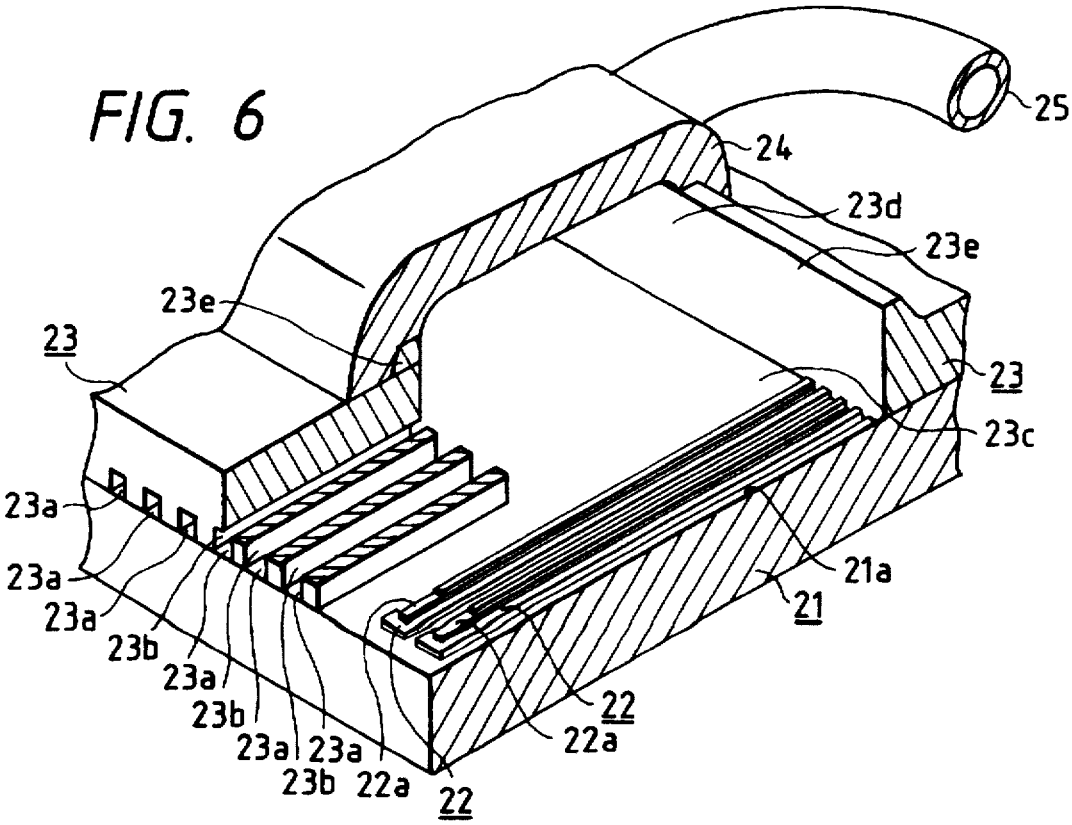
FIG. 6 is a perspective view, partially broken away, showing an ink jet recording head according to an embodiment of the present invention.

Next, another embodiment of a recording head will be described below. The recording head of this embodiment has protruding portion 23*e* protruding away from a substrate formed integrally with a structural member 23 at the pripheries around opening end on the outer side (on the side of a connector 24) of a supply port 23*d* which is an opening for communicating a void portion (liquid chamber 23*c*) to the outside, as shown in FIG. 6. Other points are the same as in the previous embodiment of the recording head, and the explanation thereof will be omitted.

The protruding portion 23*e* can serve the positioning function in connecting the connector 24 to the supply port 23*d*, and when bonding by an adhesive, a larger bonding surface can provide a stronger bonding.

Figure 7:
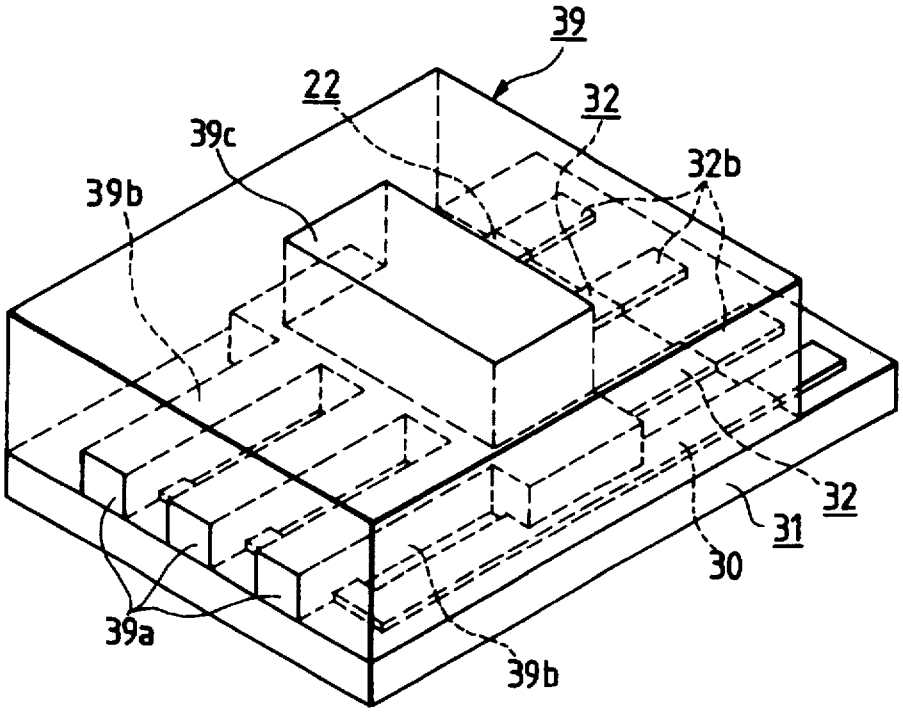
FIG. 7 is a perspective view, partially broken away, showing an ink jet recording head according to an embodiment of the present invention.

Next, a manufacturing method of an ink jet recording head using the transfer molding will be described. Herein, an instance of fabricating the ink jet recording head as shown in FIG. 7 will be described. FIG. 7 is a typical perspective view showing a constitution of the ink jet recording head.

First, the ink jet recording head as shown in FIG. 7 will be described. This ink jet recording head is the same as that shown in FIG. 5, except that to simplify the explanation, three discharge ports 39*a* are provided, and liquid channels 39*b* and energy generating elements are provided corresponding to respective discharge ports 39*a*.

While in this embodiment, three energy generating elements are provided, the number of energy generating elements, as well as corresponding liquid channels and discharge ports is not limited to three, but it will be appreciated that the number may be appropriately changed to any other number.

FIGS. 8A to 8F show a constitution of substrate 41 in the ink jet recording head. As shown in this figure, three electricity-heat converters 42 (e.g., $HfB_2$+Al+$SiO_2$+Ta), three electrodes 43 connected to heating portions of respective electricity-heat converters at one end thereof, and a common electrode 44 provided commonly to heating portions of all the electricity-heat converters 42 and connected at the other end of the electricity-heat converters 42 are formed as the film at high precision in the semiconductor manufacturing process, such as etching, vapor deposition or sputtering, and arranged at predetermined spacings. The electricity-heat converter is an energy generating element for generating the heat energy for use in discharging the ink, but besides this, a piezoelectric element for generating the mechanical energy to instantly apply the discharge pressure on the ink may be used. The side of the electrode 43 opposite to the heating portion of the electricity-heat converter 42 is an electrical connecting portion 32*b* (FIG. 7), and if voltage is applied between the electrical connecting portion 32*b* and the common electrode 44, corresponding electricity-heat converter 42 is heated.

For the purpose of improving the durability, it is the common practice that a variety of functional layers, not shown, such as a protective film are provided on the element surface 31*a* including electrodes 32 and electricity-heat converters 32*a*. This embodiment can take effect, irrespective of the existence of such functional layer and not depending on the quality of material.

Figure 8A:
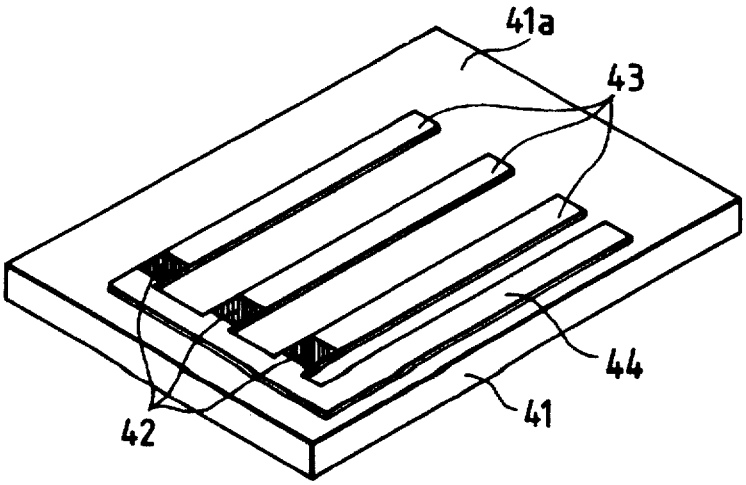
Figure 8B:
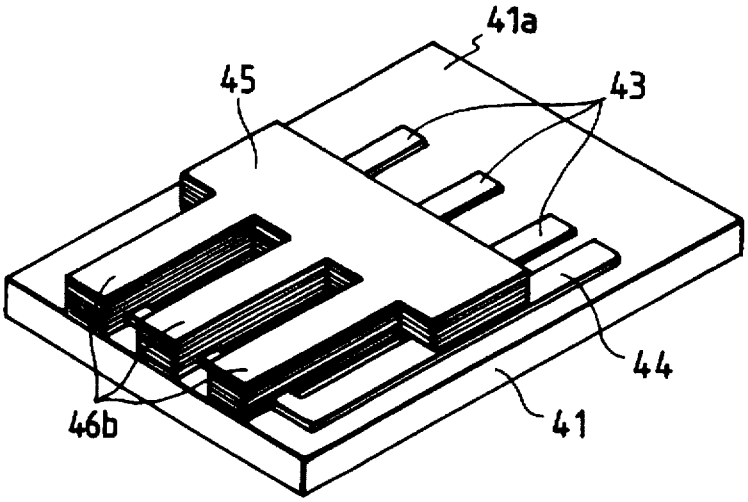

First, on the element surface 41*a* of the substrate 41, a solid layer 45 is formed as a pattern mold corresponding to discharge ports 39*a* (FIG. 7) for discharging the ink, a part of liquid chamber 39*c* (FIG. 7) for reserving the ink to be supplied to the discharge ports 39*a*, and liquid channels 39*b* (FIG. 7) for communicating the discharge ports 39*a* to the liquid chamber 39*c*, as shown in FIG. 8B. As a result, three liquid channel corresponding portions 46*b* corresponding to liquid channels 39*b* in the solid layer 45 cover respective electrodes 43 and heating portions of the electricity-heat converters 42.

The solid layer 45 is made of a material which is removable in a later process. The material of the solid layer 45 and the forming method are described below. That is, the solid layer 45 is formed in such a manner that 1) A liquid photosensitive resin (photosensitive base is either positive or negative) is applied on the substrate 41, and using the photolithography, 2) A dry film-like photosensitive resin (either positive or negative) is laminated on the substrate 41, and using the photolithography, 3) A curable or incurable resin is printed on the substrate 41, 4) A metallic film is selectively laminated on the substrate 41 or removed therefrom.

In this case, from the viewpoint of easier operation and removal in the later process, and a necessary accuracy in processing, the photolithography as above cited in 1) and 2) is preferable, and particularly, the photosensitive resin having a positive photosensitive base is preferably used.

As an example, photolithography means can be used in which a positive or negative type dry developing photoresist or dry film having an appropriate thickness is applied or pasted on the element surface 41*a*, a pattern corresponding to the discharge ports, the liquid channels 46*b* and the liquid chamber 46*c* in the photoresist or dry film is exposed with or without a mask, and developed, so that the solid layer 45 having the pattern corresponding to the discharge ports 46*a*, the liquid channels 46*b* and the liquid chamber 46*c* is formed on the element surface 41*a*. In this case, it is required that the material of photoresist or dry film be dissolved and removed by a solvent in a process as described thereinafter. Also, the positive type photoresist (photosensitive dry film) is more preferable than the negative type, because it is more efficient in removing the patterned solid layer 26 which is dissolved and removed in the process as described thereinafter, and can be formed in a more rectangular cross section. Besides the photolithography means, printing means such as the screen printing or the intaglio printing with an intaglio made by etching a metal substrate (e.g., NiCu) can provide the patterned solid layer 46 in an appropriate thickness. Examples of the material of the solid layer applicable to such printing means include water soluble polyvinylalcohol resin, or solvent soluble vinyl chloride, vinyl acetate, vinyl chloridevinyl acetate copolymer and styrene resin.

Since the leading end portions of liquid channels 39*b* become the discharge ports 39*a*, it is advantageous to provide the solid layer 45 destined for the liquid channels 39*b* extending up to an outer end portion of the substrate 41, because the discharge ports 39*a* are formed at respective positions on an end face of the substrate 41.

Figure 8C:
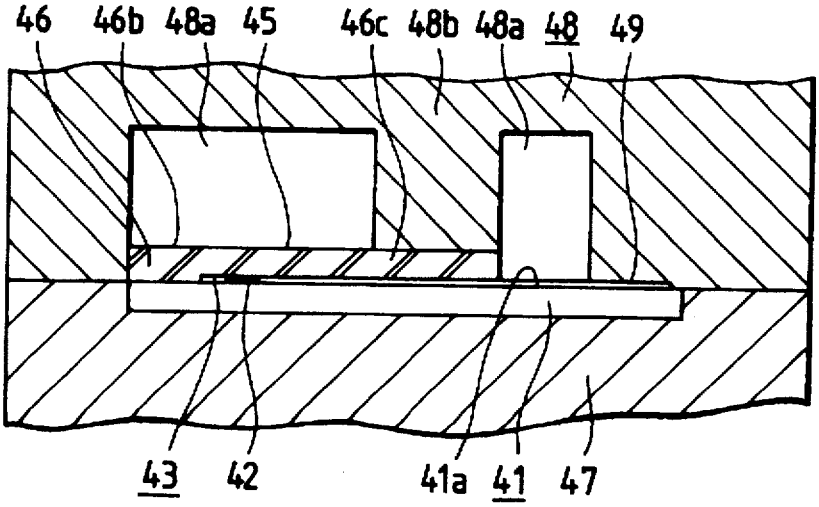

Next, by the transfer molding, the structural member 39 (FIG. 7) is fused onto the element surface 41*a* of the substrate 41 on which the solid layer 45 is formed at the same time with the molding. A mold for use with the transfer molding consists of a first mold 47 and a second mold 48, as shown in FIG. 8C. The first mold 47 is formed with a recess portion having the depth equal to the thickness of the substrate 41, into which the substrate 41 is fitted and fixed, and when the substrate 41 is fitted into this recess portion, the element surface 41*a* of the substrate 41 is flush with the parting plane.

Herein, the depth of the recess portion in the first mold 47 is made equal to the thickness of the substrate, but when the substrate 41 is covered partially or totally in the transfer molding, another space (into which the transfer material can flow) should be made in an under portion of the substrate 41.

On the other hand, the second mold 48 is formed with a cavity portion 48*a* for molding the structural member 39 (FIG. 7) constituting the discharge ports 39*a*, the liquid channels 39*b* and the liquid chamber 39*c*, in which a part of inner wall of the cavity portion 48*a* abuts against each of three discharge port corresponding surfaces 46*a* which are surfaces corresponding to the discharge ports 39*a* of the solid layer 25, when the mold is clamped. Also, the second mold 48 is formed with protruding portion 48*b* inside the cavity portion 48*a*, serving to form a void portion which becomes the liquid chamber 39*c* and the supply port for supplying the ink from the outside into the liquid chamber on the structural member 39, whereby a top end face of the protruding portion 48*b* abuts against an upper surface of the liquid chamber part corresponding surface 46, as shown, which corresponds to a part of the liquid chamber 39*c* in the solid layer 45, when the mold is clamped. Also, a part of the element surface 41*a* of the substrate 41 including electrical connecting portions 43*b* of electrodes 43 will bulge out of the cavity portion 48*a* to the parting face side of the second mold 48, when the mold is clamped.

The mold opening direction for the first and second molds 47 and 48 is perpendicular with respect to the element surface 41*a* of the substrate 41. The transfer molding can be performed by clamping the mold, and pouring the molding material through a pot and a runner (not shown) into the cavity portion 48*a*.

In molding the structural member, each discharge port corresponding surface 46*a* abutting against the inner wall of cavity portion 48*a* in the second mold 48 and the liquid chamber part corresponding portion 46*c* abutting against the top end face of the protruding portion 48*b* in the solid layer 45 will melt slightly due to the heat the molding to adhere to the inner wall of the cavity portion 48*a* and the top end face of the protruding portion 48*b*, thereby preventing the molding material from penetrating therein.

Also, in order to prevent the molding material from entering unnecessary portion more reliably, a soft member such as silicone rubber, fluororubber or polytetrafluoroethylene may be pasted on the top end face of the protruding portion 48*b*.

Figure 8D:
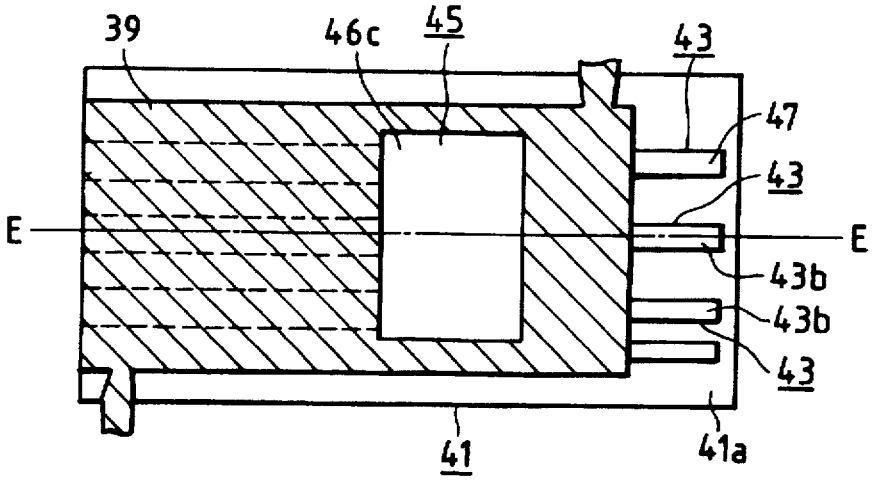
Figure 8E:
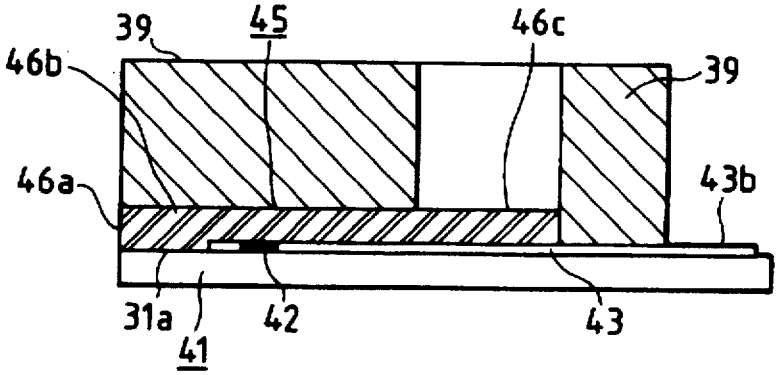

By performing such transfer molding, the structural member 39 is fused on the element surface 41*a* of the substrate 41 on which the solid layer 45 is formed at the same time with the molding as shown in FIGS. 8D and 8E. The structural member 39 has exposed electrical connecting portions 43*b* of electrodes 43, and over the surface of the solid layer 26, a surface of the liquid chamber part corresponding portion 46 against which the protruding portion 48*b* of the second mold 48 abuts and the discharge port corresponding surface 26*a* are exposed, and other surfaces are covered.

The transfer molding can be made using a thermosetting epoxy resin as the material of the structural member (molded member) 39, under the general molding conditions such that the resin preheating temperature is 60° to 90° C., the injection pressure is 20 to 140 kgf/cm$^2$, the molding temperature is 100° to 180° C., and the curing time is 1 to 10 min. with a postcure after molding. Other materials of the structural member 29 are a cold setting, thermosetting, or ultraviolet setting liquid material, examples of which include epoxy resin, acrylic resin, diglycol-dialkylcarbonate resin, unsaturated polyester resin, polyurethan resin, polyimide resin, melamine resin, phenol resin, and urea resin. A variety of thermoplastic synthetic resins can be also used. Whichever synthetic resin is used, the synthetic resin making up the structural member 39 must be incompatible to the solid layer 45, and has a lower thermosoftening temperature than the solid layer 45.

Figure 8F:
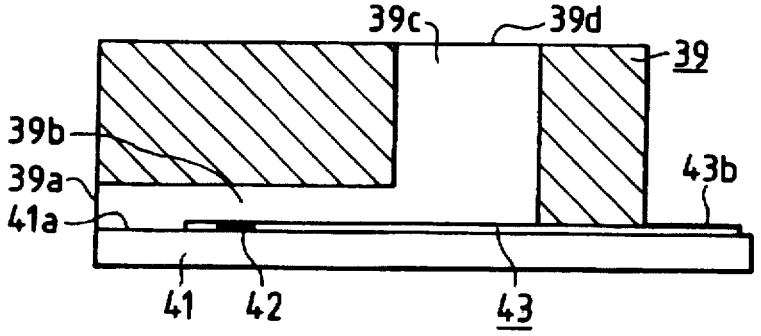

Next, the solid layer 45 is removed from the substrate 41 onto which the structural member 39 is fused at the same time with the molding. Means for removing the solid layer 45 is optimally selected in accordance with the material forming the solid layer 45, but generally, such means for removing the solid layer by immersing the substrate 21 having the structural member 39 fused at the same time with the molding into a solvent solution capable of dissolving, swelling or peeling the solid layer 45 is used. In this time, removal accelerating means such as ultrasonic processing, spray, heating or agitation, can be also used if necessary. When a positive type photosensitive resin is used for the solid layer 45, a water solution containing ketones, mainly acetone, ester, alcohol or alkali can be used as the solvent for removal. In FIG. 8F, the solid layer 45 is removed from the substrate 41 having the structural member 39 fused at the same time with the molding. Inside the structural member 39, a space is formed after the removal of solid layer 45, and constitutes three discharge ports 39*a*, three liquid channels 39*b*, the liquid chamber 39*c* and the supply port 39*d*.

In this way, the ink jet recording head as shown in FIG. 7 can be fabricated. Then, the registration of each liquid channel 39*b* with respect to heating portion of each electricity-heat converter 42 provided on the element surface 41*a* of the substrate 41 can be achieved in forming the solid layer 45 on the element surface 41*a*, so that there is no need for a complex and expensive device for bonding minute energy generating elements of the first substrate with the minute liquid channels of the second substrate in precise registration, as found in conventional methods.

The process for providing the structural member 39 which constitutes the discharge ports 39*a*, the liquid channels 39*b* and the liquid chamber 39*c* is simpler and shorter in time than a conventional complex and laborious process in which the structural member is provided in such a way as to coat the structural member with a curable material including a curing agent and leave it intact for a long time, or to illuminate the structural member with the activation energy line after applying an activation energy line curable material thereon, because the structural member 39 is fused onto the element surface 41*a* having the solid layer 45 formed thereon at the same time with the molding by the transfer modling. Also, when the structural member 39 is molded, the supply port can be also molded at the same time. Further, the liquid chamber 39*c* can be formed in any large volume, without restriction by the thickness of the solid layer 45.

Herein, the incompatibility between the solid layer 45 and the synthetic resin making up the structural member 39 will be described. The incompatibility means not to melt together, i.e., to have no compatibility or very low compatibility, in which it is necessary to be incompatible not only at room temperature, but also at manufacturing temperature (molding temperature).

The method of examining the compatibility is as follows. A material making up the solid layer 45 and a synthetic resin making up the structural member 39 are dissolved and mixed into a solvent having a high solubility for both of them [a solvent having a typical high solubility for various resins such as DMF (dimethylformamide), DMSO (dimethyl sulfoxide) or ketones is effective], and applied on a transparent plate such as a glass plate and dried. When there is the compatibility, a transparent resin layer is formed on the transparent plate, while in the incompatibility, a milk white or white resin layer is formed, whereby the compatibility or incompatibility can be judged by observing the transparent plate. Further, the judgment of the compatibility or incompatibility at manufacturing temperature can be performed in such a way as to heat this transparent plate gradually up to a specified temperature and observe whether the resin layer is transparent, or milk while to while.

Next, a measuring method of the thermosoftening temperature will be described. The thermosoftening temperature can be commonly obtained by measuring the penetration degree of needle with a device such as TMA (thermal mechanical analyzer). This method is carried out by placing a needle with a fixed load on a test piece, elevating the temperature of the entire system gradually, and measuring the temperature at which the needle penetrates into the test piece, whereby the quantitative measurement can be made. As the material making up the solid layer and the synthetic resin making up the structural member are both typically curable, the comparison of the thermosoftening temperature should be made by measuring the thermosoftening temperature before and after curing and with the temperature change in the actual manufacturing process. The difference between the thermosoftening temperature of the material making up the solid layer and that of the synthetic resin making up the structural member is preferably above 10° C., and more preferably above 15° C., and most preferably above 20° C.

Next, the results of actually fabricating the ink jet recording head in this embodiment will be described.

The solid layer 45 used a dry developing photoresist of polycarbonate type which was patterned with the exposure and development, and the synthetic resin making up the structural member 39 used a curable epoxy resin composed of acryl-epoxy-halfester-oligomer and polyamide. This dry developing photoresist is one in which the exposed portion only becomes gaseous and scattered by heating, and can be obtained by adding onium salt as photooxidation agent to polycarbonate (Polymer J., 19(1), 31(1987)). The thermosoftening temperature at the exposed portion of the dry developing photoresist was 70° C. (decomposition), and the thermosoftening temperature at the unexposed portion was 200° C. On the other hand, the thermosoftening temperature of the curable epoxy resin was 160° C. at blend state (uncured state), and 220° C. after curing. In this case, the thermosoftening temperature at the solid layer 26 is 200° C. because of the unexposure portion used as the solid layer 26, and the thermosoftening temperature of the synthetic resin making up the structural member 29 is 160° C. because of its use before curing.

The compatibility was examined by the previous method in which both the dry developing photoresist and the synthetic resin are dissolved into DMF and applied on the glass plate, so that the incompatibility was confirmed in a temperature range from room temperature to 200° C.

The ink jet recording head as shown in FIG. 7 was fabricated with a procedure as shown in FIGS. 8A to 8F, so that an excellent ink jet recording head without deformation of the liquid channels could be obtained.

While this embodiment was described, it is unnecessary to use a strong solvent for the development because of the use of the dry developing photoresist as the solid layer 45, and thus unnecessary to use specifically a curable/ crosslinking resin as the synthetic resin making up the structural member 39, whereby the thermoplastic plastics having excellent characteristic is usable.

Next, another example of a manufacturing method of a recording head will be described.

In the embodiment of the manufacturing method of the recording head as above described, the discharge port corresponding surface 46*a* was formed in the solid layer 45, the structural member 39 was molded with the discharge port corresponding surface 46*a* exposed, and after the discharge port corresponding surface 46*a* was removed, the openings themselves became the discharge ports 39*a*, whereas in this embodiment, a liquid channel corresponding portion of the solid layer is provided on the element surface of the substrate to be extended beyond the positions where the discharge ports are formed, and the structural member is fused on the element surface at the same time with the molding, and, after releasing the mold, cut off with a resin board diamond blade (with a thickness of 0.3 mm, #2400) at the position of forming the discharge ports in the state where the structural member and the substrate are fused together, and then the solid layer is removed after polishing of the cut face. Other points are the same as in the previous embodiment of the manufacturing method of the recording head, and the explanation will be omitted.

This embodiment has an advantage that the cut face becomes the discharge port face where a plurality of discharge ports are arranged in parallel, but as the solid layer is not yet removed in polishing the cut face, shavings of polishing will not enter the liquid channels. Other points are the same as in the previous embodiment of the manufacturing method of the recording head.

Next, another embodiment of the manufacturing method of the ink jet recording head according to the present invention will be described. In this embodiment, two ink jet recording heads as shown in FIG. 7 are fabricated at a time (so-called two-piece fabrication), in which two pieces of ink jet recording head are fabricated collectively in such a positional relation that the discharge ports are opposed to each other, and then cut off at the central portion (the position of forming discharge ports) to obtain two ink jet recording heads. FIGS. 9A to 9D are views for explaining this manufacturing method.

Figure 9A:
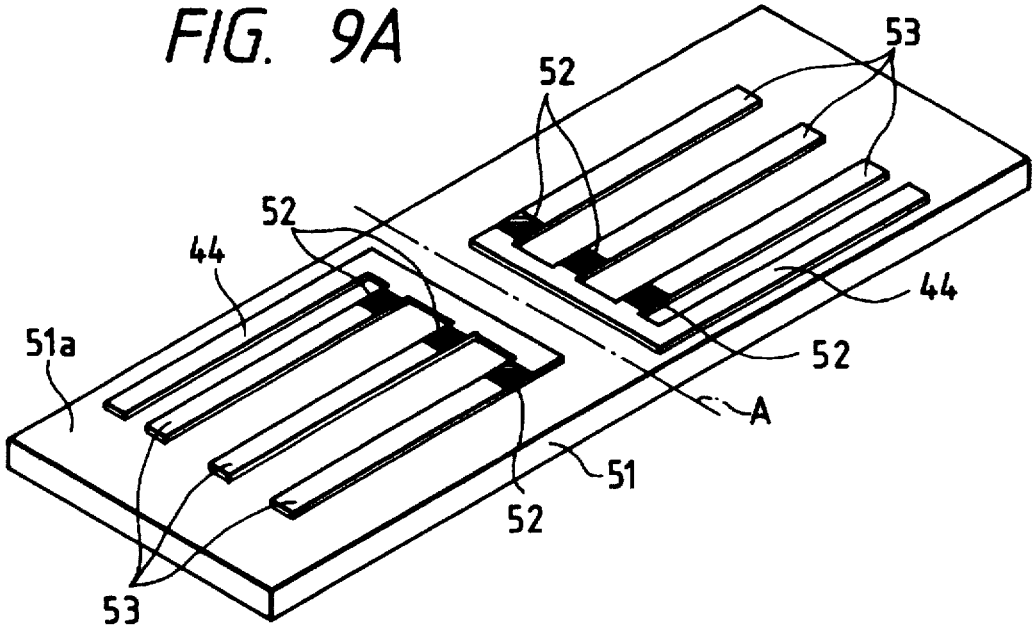

As shown in FIG. 9A, on the element surface 51*a* of the substrate 51 as large as the size corresponding to two recording heads opposedly arranged, the heating portions of the electricity-heat converters 52*a*, the electrodes 53, and the common electrode 40 are formed in the number corresponding to two ink jet recording heads (a case of six is shown in this embodiment). In this case, the heating portions of electricity-heat converters 52*a* are arranged in symmetry about the cutting position (discharge port forming position A as shown) in a later process. By doing so, corresponding liquid channels of two ink jet recording heads are advantageously concatenated in the straight line.

Figure 9B:
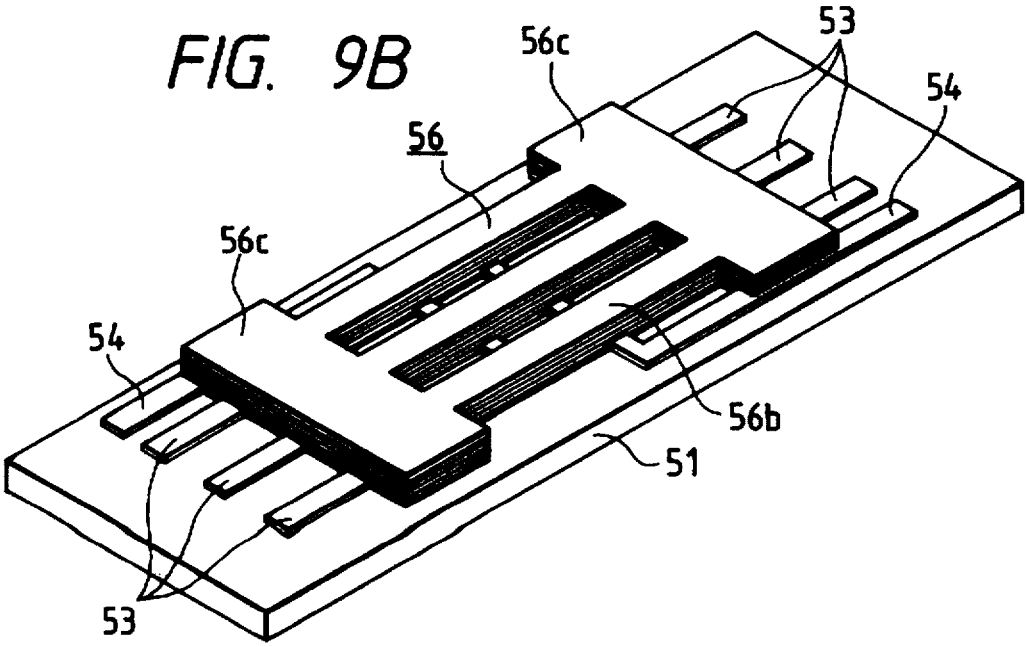

Next, as shown in FIG. 9B, the solid layer 55 is laminated on the portion to be used as the liquid channels and the portion to be used as a part of the liquid chamber. As the electricity-heat converters 52 are arranged in symmetry with respect to the discharge port forming position A, the portion to be used as the liquid channels, i.e., liquid channel corresponding portion 56*b* is provided continuously in the straight line from the portion to be used as a part of one liquid chamber (lower end), i.e., liquid chamber part corresponding portion 56*c* to the other liquid chamber part corresponding portion 56*c*. At this time, the solid layer on the portion to be used as the liquid channels and the solid layer corresponding to the liquid chamber may be integrally or separately provided.

As in the above embodiment, two structural members 59 corresponding to two ink jet recording heads are formed integrally by the transfer molding. Also in this case, a material making up the solid layer 55 and a synthetic resin making up the structural member 59 are incompatible, as in the above-described embodiment, and the thermosoftening temperature for the synthetic resin is lower. Afterwards, the structural members are cut off at the plane including the discharge port forming position A and vertically to the substrate 51 as the cutting face. As a result, the discharge ports appear on the cutting face because the portions to be used as the liquid channels for both ink jet recording heads are continuously arranged in the straight line, so that two ink jet recording head corresponding portions can be formed. Afterwards, if the cutting face is polished and the solid layer 55 is removed, two ink jet recording heads in the same constitution as above described can be fabricated simultaneously.

Figure 9C:
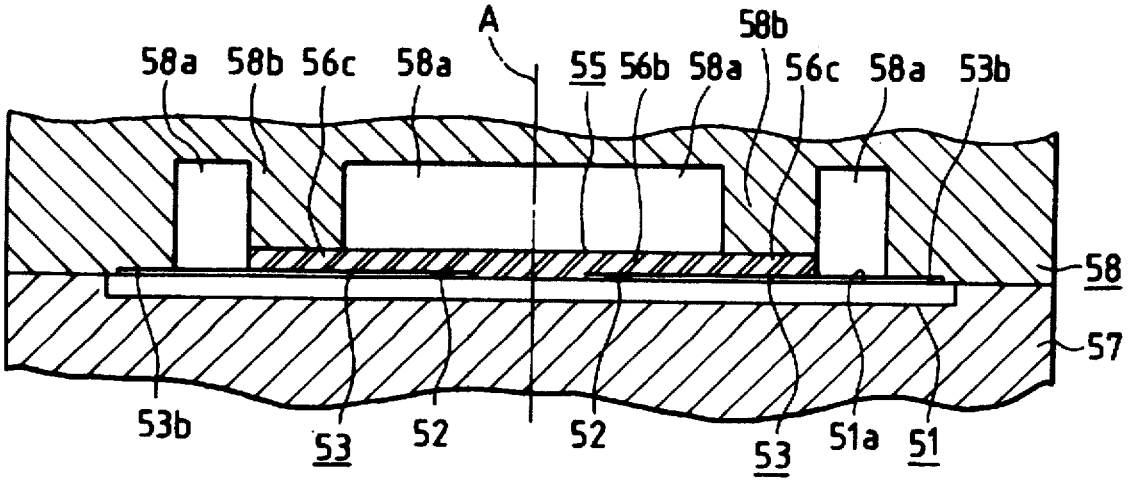

Next, a mold useful in the transfer molding will be described. FIG. 9C is a cross-sectional view of the mold on which the substrate 51 with the solid layer 55 completely formed is mounted. A first mold (lower mold) 57 is provided with a recess portion of the shape identical to that of the substrate 51, which is then fitted into this recess portion. A second mold (upper mold) 58 is provided with a cavity portion 58*a* correspondingly to the recess portion of the first mold 57, as in the above embodiment. Two projecting portions 58*b* corresponding to respective liquid chambers of two ink jet recording heads are provided in the cavity portion 58*a*. In the same way as the above embodiment, a top end of the projecting portion 58*b* abuts against the liquid chamber part corresponding portion 56*c*, and by injecting and curing a molding material through a pot and a runner (not shown) into the cavity portion 58*a* in this state, two structural members 59 integrally formed corresponding to two ink jet recording heads can be fused and formed collectively on the substrate 51.

Figure 9D:
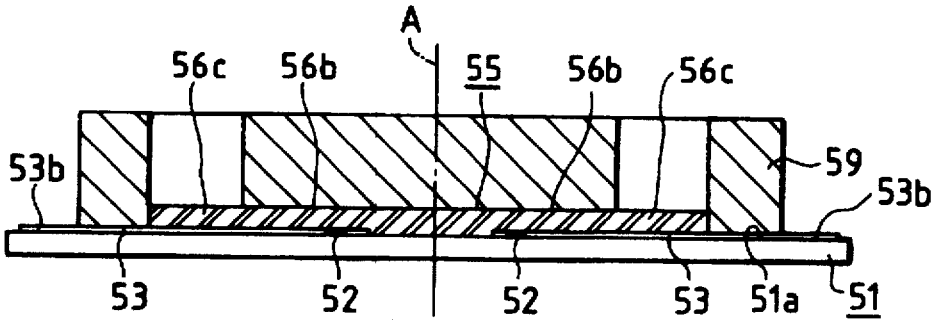

The structural member 59 as shown in FIG. 9D has been fused onto the element surface 51 of the substrate 51 having the solid layer 55 formed thereon, at the same time with the molding by the transfer molding, using the first mold 57 and the second mold 58. The substrate 51 onto which the structural members 59 corresponding to two recording heads are fused at the same time with the molding is cut off at the discharge port forming position A after releasing the mold, and, after the cut face (including the cut face of the structural member 59) of each of two pieces separated from the substrate 51 is polished, the solid layer 55 remaining inside is removed.

Other points than above described are the same as in the previous embodiment of the manufacturing method of the recording head, and the explanation will be omitted.

This embodiment has an advantage that two recording heads can be obtained at a time with the almost same processes as in the previous embodiments of the manufacturing method of the recording head.

Next, another embodiment of the manufacturing method of the recording head will be described. This embodiment is an application of the method of obtaining two recording heads at a time as in the previous embodiments of the manufacturing method of the recording head, that is, a method of obtaining a plurality of pairs of recording heads at a time with two recording heads as a pair.

Figure 10A:
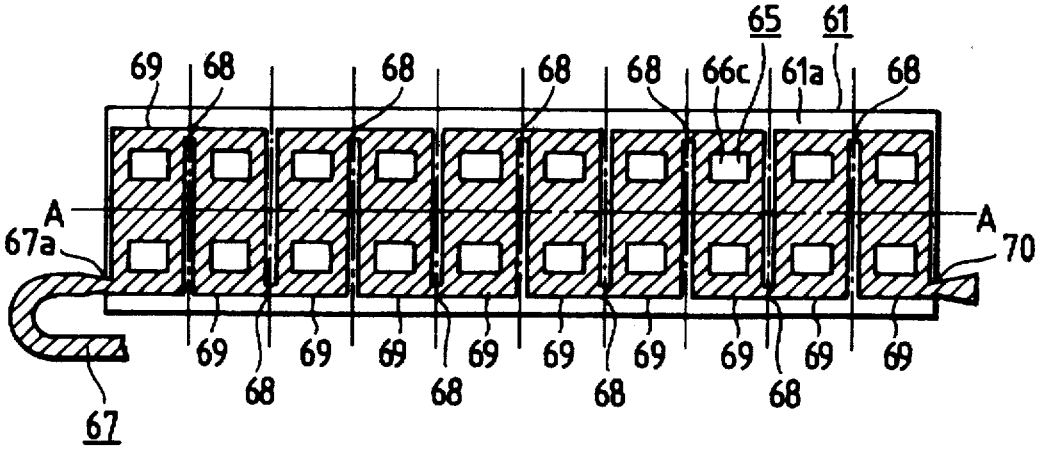
Figure 10B:
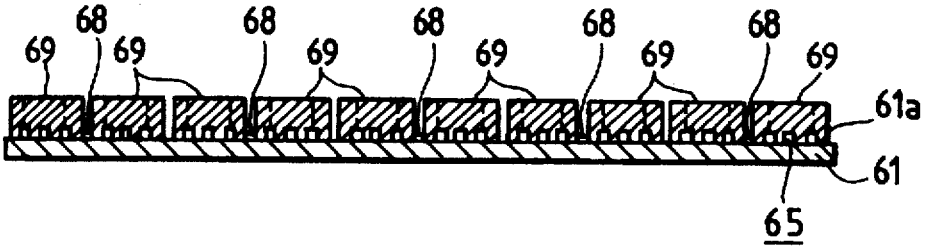

In FIGS. 10A and 10B, on an element surface 61*a* of a strip-like substrate 61 are formed heating portions of electricity-heat converters, electrodes and common electrodes in the numbers correspond to the number of ink jet recording heads to be formed, and with two structural members 69 corresponding to two recording heads as a pair, a plurality of pairs (10 pairs in the figure) of structural members 69 arranged in parallel, with their opposed surfaces in the arrangement thereof being shared (in concatenated state), are fused onto the element surface at the same time with the molding, by the transfer molding, upon which the structural members 69 of each pair are symmetrical with respect to the discharge port forming position which corresponds to opposed surfaces in the opposed arrangement. On the element surface 61*a* of the substrate 61 are provided the electrodes (not shown) connected to the heating portions of the electricity-heat converters, and the solid layers 65, of course in the numbers corresponding to the plurality of pairs of structural members 69.

The arrangement of runner for use in molding the plurality of pairs of structural members 69 will be described. A gate portion 67*a* of a main runner 67 consecutively provided from a sprue (not shown) is disposed on a portion at one end remote from the discharge port forming position A of one pair of structural members 69 at the left most end as shown, and subrunners 68, each consecutive to one adjacent pair of structural members 69, are disposed at alternating end portions, oppositely to the gate portion 67*a*, remote from the discharge port forming position A on every pair of structural members 69. The subrunners 68 are disposed alternately between the plurality of pairs of structural members extending from left to right end, on both sides of the discharge port forming position A in the same configuration, and the structural member 69 of the pair at the right end has an air bleeding portion 70 disposed at a position diametrically opposite to the last subrunner 68.

By arranging the runner in the above way, the molding material can be extended uniformly, and even if each structural member 69 is distorted due to residual internal stress after the molding, the distortion near the discharge ports can be minimized because the positions of subrunners 68 and the gate portion 67*a* are left far away from the discharge ports.

The substrate 61 onto which the plurality of pairs of structural members 69 are fused at the same time with the molding is cut off at the discharge port forming position A after releasing the mold, the cut face (including the cut face of each structural member 69) of each of two pieces divided from the substrate 61 is polished, and then the solid layer 65 remaining inside is removed. Also, it will be appreciated that one recording head corresponding portions may be obtained by cutting off each divided substrate 61 along the boundary line between two adjacent structural members, then polishing, and removing the solid layers 65.

Other points than above described are the same as in the previous embodiments of the manufacturing method of the recording head, and the explanation will be omitted. In this embodiment, it is possible to fabricate a plurality of recording heads at a time. Where the substrate 61 onto which the plurality of pairs of structural members 69 are fused at the same time with the molding is cut off along the discharge port forming position A after releasing the mold, and then the solid layer 65 is removed from the two separated substrates, it is simpler to handle the removal of the solid layer because recording head corresponding portions are left unseparated.

Next, still another embodiment of the manufacturing method of the recording head will be described.

Figure 11:
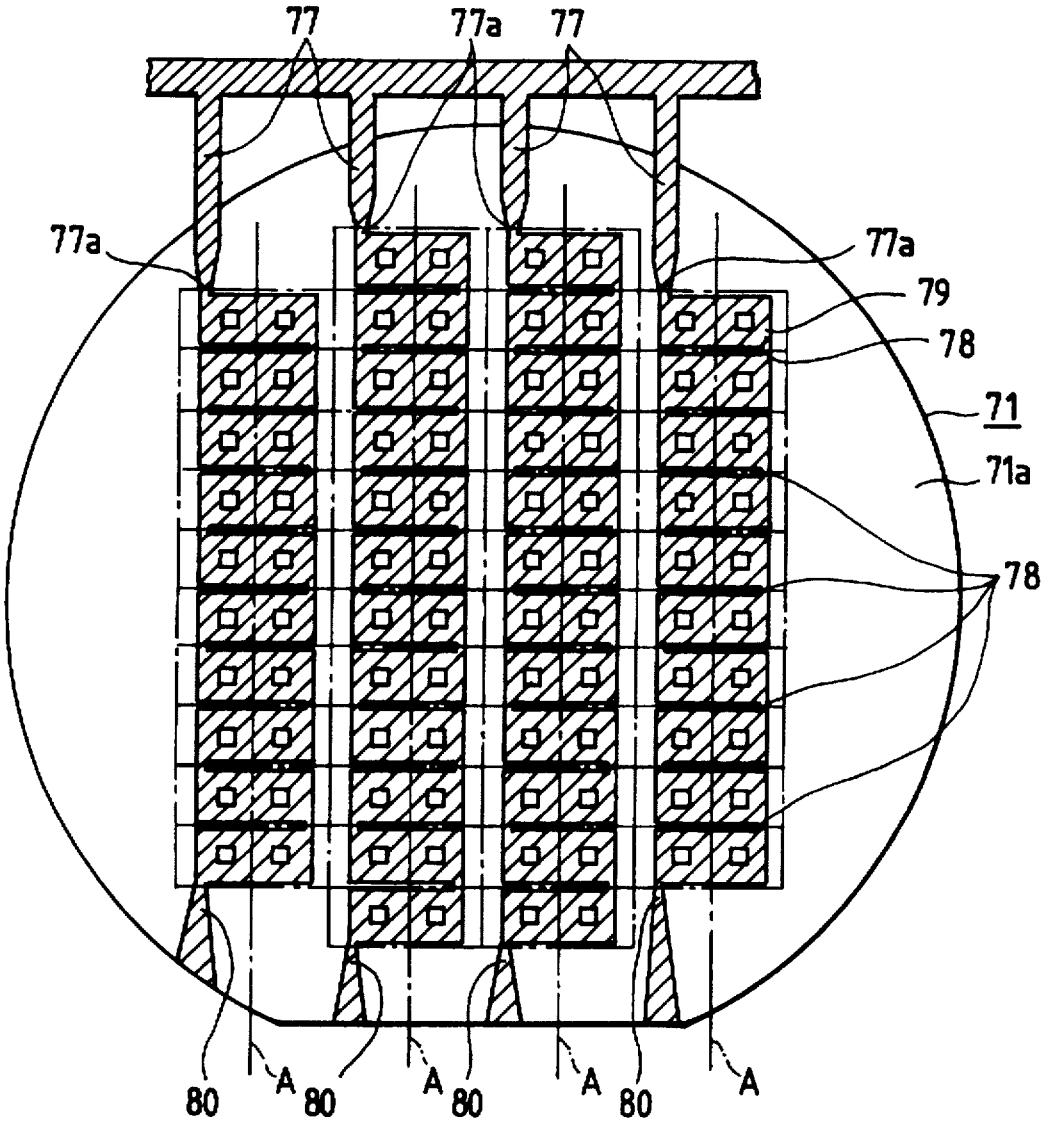
FIG. 11 is a view showing manufacturing method of an ink jet recording head.

In the previous embodiment of the manufacturing method of the recording head, a plurality of pairs of the structural members 69 are fused onto the element surface 61*a* of strip-like substrate 61 at the same time with the molding, whereas in this embodiment, a plurality of pairs (44 pairs or 88 pieces are exemplified in the figure) of structural members 79 are fused onto the element surface 71*a* of a disk-like substrate 71 such as a silicone wafer (with a diameter of 5 inch) at the same time with the molding, as shown in FIG. 11. Forty four pairs of structural members 89 are arranged in four columns, with one main runner 77 provided for each column. The subrunners 78 and the air bleeding portions 80 are disposed in the same configuration as in the previous embodiment of the manufacturing method of the recording head.

The embodiments of the present invention will be described with reference to the drawings. The following embodiments are accomplished in the same way as in the previous embodiments using FIGS. 5 to 11, except for the content involving an adherent layer which is a characteristic item of the present invention.

Figure 1:
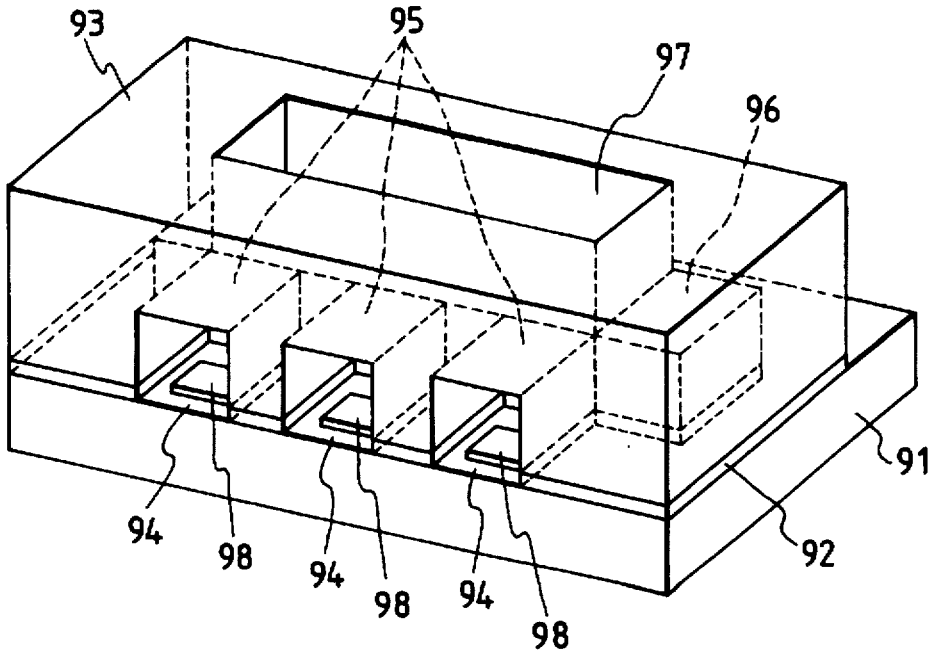
FIG. 1 is a schematic perspective view showing an ink jet recording head according to a first embodiment of the present invention.

FIG. 1 is a schematic perspective view of an ink jet recording head (thereinafter referred to as "recording head") according to a first embodiment of the present invention.

In FIG. 1, heating portions of electricity-heat converters 98 as the energy generating element are formed as the film in a semiconductor manufacturing process, such as etching, vapor deposition or sputtering, and arranged at predetermined spacings on one surface of a substrate 1 made of glass or silicone wafer, this one surface being an element surface. Also, on the element surface including the heating portions of the electricity-heat converters 98, an inorganic protective film (not shown) is provided in order to improve the durability.

Also, on a portion of the element surface except for discharge ports 94, liquid channels 95 and a liquid chamber 96, a polyimide resin layer 92 as the adherent layer is provided. Polyimide is suitable for making up the adherent layer because of its capability of highly accurate patterning by virtue of its excellent light sensitivity, the excellent fusion (adhesion) between the inorganic film and a structural member (epoxy resin) 93 as will be described later, and its resiliency (cushioning). In this embodiment, polyimide resin layer "PIQ" manufactured by Hitachi Chemical having a layer thickness of 2 μm was used. Note that the thickness of the adherent layer is preferably 1 μm or more from the respect of the effectivity, and 3 μm or less from the respect of preventing the occurrence of distortion.

Further, a structural member 93 made of epoxy resin is fused onto the polyimide resin layer 92 at the same time with the molding by the transfer molding. On a face of the structural member 93 opposed to the element surface, a plurality of groove portions are formed corresponding to respective positions of electricity-heat converters 98, with each space surrounded by each groove portion and the element surface 1*a* constituting a liquid channel 3*b*, and each opening outward from each space constituting a discharge port 94. Also, the structural member 93 is formed with a void portion communicating to the groove portions (liquid channels 95) and having the element surface as a bottom wall, thereby constituting a liquid chamber 96, and moreover, an opening for communicating the void portion (liquid chamber 96) to the outside is opened toward the same direction as that toward which the element surface faces to provide a supply port 97.

Other points than above described are the same as in the previous embodiments of the manufacturing method of the recording head, and the explanation will be omitted.

This embodiment can also provide the same effects as the previous embodiments of the manufacturing method of recording head.

The supply port 97 has a supply tube connected to an ink tank (not shown), whereby the ink is supplied from the ink tank through the supply tube to the liquid chamber 96.

Herein, the operation in discharging the ink through each discharge port 94 will be described. The ink supplied to the liquid chamber 96 and temporarily stored therein is supplied to liquid channels 95 with a capillary action, forming a meniscus at each discharge port 94 and keeping each liquid channel 95 filled with the ink. Then, the heating portions of electricity-heat converters 98 are heated by the energization, causing the ink on the heating portions of the electricity-heat converters 98 to be rapidly heated and produce bubbles within the liquid channels 95, so that the ink is discharged through the discharge ports 94 based on the creation of bubbles.

While in this embodiment, the energy generating element for generating the energy for use in discharging the ink was an electricity-heat converter, the invention is not limited to such a form, but it should be noted that a piezoelectric element for generating the mechanical energy acting to instantly apply the discharge pressure onto the ink may be used.

In the following, the manufacturing process of a recording head in this embodiment will be described.

First, electricity-heat converters 98 are formed as the film on the element surface of the substrate 91, in a semiconductor manufacturing process, such as etching, vapor deposition or sputtering, and an inorganic protective film is provided on the element surface including the electricity-heat converters 98.

Then, on a portion of the element surface except for discharge ports 94, liquid channels 95 and a liquid chamber 96, a polyimide resin layer 92 is provided by the patterning. Further, on a portion of the element surface for discharge ports 94, liquid channels 95 and the liquid channel 96, a solid layer (not shown) removable in a later process is provided. Examples of the material and means for use in forming the solid layer are listed below.

① A solid layer is formed in accordance with an image formation process, using a photosensitive dry film.

② A solvent soluble polymer layer and a photoresist layer, in desired thicknesses, are sequentially laminated on the substrate 1, and the solvent soluble polymer layer is selectively removed after a pattern of the photoresist layer is formed.

③ Resin is printed.

The photosensitive dry film of ① may be either a positive type or a negative type, but the positive type dry film is preferably soluble in a developer with the irradiation of the activation energy line, while the negative type dry film is preferably a photopolymerization type but dissolvable or removable by methylene chloride or strong base.

The solvent soluble polymer of ② may be any high molecular compound as long as a dissolving solvent can be provided, and a coat can be formed by the coating. Typical examples of the photoresist for use herein include a positive type liquid photoresist composed of novolak type phenolic resin and naphthoquinone diazide, a negative type liquid photoresist composed of polyvinyl cinnamate, a negative type liquid photoresist composed of cyclorubber and bisazide, a negative type photosensitive dry film, and the ink of thermosetting type and ultravioletsetting type.

Examples of the material for forming the solid layer with the printing method of ③ include a lithographic ink, a screen ink and a transfer type resin which are used in the dry method of evaporation type, thermosetting type or ultravioletsetting type.

After forming a polyimide resin layer 92 and a solid layer on the element surface, the structural member 93 as well as the substrate 91 are molded by the transfer molding. The structural member 93 is fused onto the polyimide resin layer 92 at the same time with the molding.

If the structural member 93 is molded, the solid layer is removed by appropriate means, so that discharge ports 94, liquid channels 95 and a liquid chamber 96 are formed on the portion where the solid layer exists.

In general, in order to improve the productive efficiency, the recording head is fabricated in such a way that a substrate of the size corresponding to the arrangement of a plurality of recording heads is used to mold a structural member thereon to have a plurality of recording heads integrally formed, and then cut off at predetermined positions to obtain a plurality of recording heads. The manufacturing process of the recording head in this case is the same as above described, in which the cutting is made before the removal of the solid layer.

As above described, the substrate 91 and the structural member 93 are fused together via polyimide resin layer 92, so that the adhesion of structural member therewith can be improved and the substrate 91 and the structural member 93 are less likely to be peeled off. When a plurality of recording heads are obtained by cutting off the substrate and the structural members corresponding to the plurality of recording heads integrally formed, the vibration of the substrate 91 and the structural member 94 occurring at the cutting can be absorbed into the polyimide resin layer 92, because the polyimide resin layer 92 has a resiliency (cushioning), so that the substrate 93 is unlikely to crack with the vibration at the cutting. Specifically, the occurrence rate of exfoliation of the structural member from the substrate was 15% in the conventional recording head, whereas it was 3% in the recording head of this embodiment. The occurrence rate of cracks at the cutting was 10% in the conventional recording head, whereas it was 1% in the recording head of this embodiment. That is, the yield could be greatly improved from 75% to 96%.

(Second embodiment)

Figure 2:
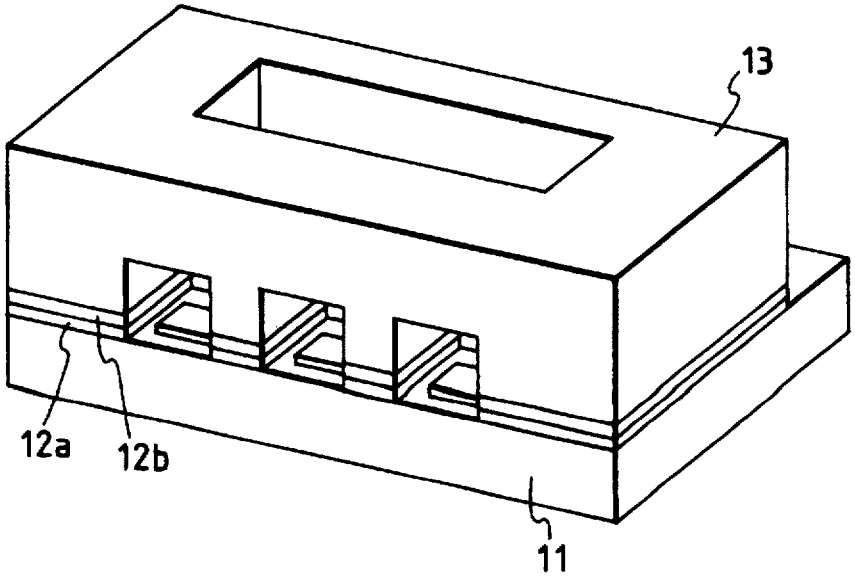
FIG. 2 is a schematic perspective view showing an ink jet recording head according to a second embodiment of the present invention.

FIG. 2 is a schematic perspective view of a recording head according to a second embodiment of the present invention. This embodiment is different from the first embodiment in that the adherent layer has a two-layer structure consisting of a layer for improving the adhesion and a layer having the cushioning.

As shown in FIG. 2, the substrate 11 and the structural member 13 are fused via silane coupling material **12*a* (in this embodiment, a layer 1 μm thick of "KBM403" manufactured by The Shin-Etsu Chemical) applied onto the element surface of the substrate 11 and a photosensitive epoxy resin 12*b* (in this embodiment, a layer 1 μm thick of "3101" manufactured by Three Bond) laminated on the silane coupling material 12*a*, at the same time with the molding by the transfer molding. The silane coupling material 12*a* and the photosensitive epoxy resin 12*b* constitute an adherent layer having the cushioning and improving the adherence between the substrate 11 and the structural member 13. Herein, the silane coupling material 12*a* has a feature of improving the adherence with the substrate 11. The photosensitive epoxy resin 12*b*** has the cushioning. Other constitutions are the same as those in the first embodiment, and the explanation is omitted.

In this way, even if the adherent layer is constituted of the layer having a feature of improving the adhesion and the layer having the cushioning, the same effects as in the first embodiment can be obtained.

In the embodiments as above described, the number of discharge ports and corresponding liquid channels or energy generating elements were described in three, but the number is not limited to three, and may be increased or decreased as necessary.

(Third embodiment)

Figure 3:
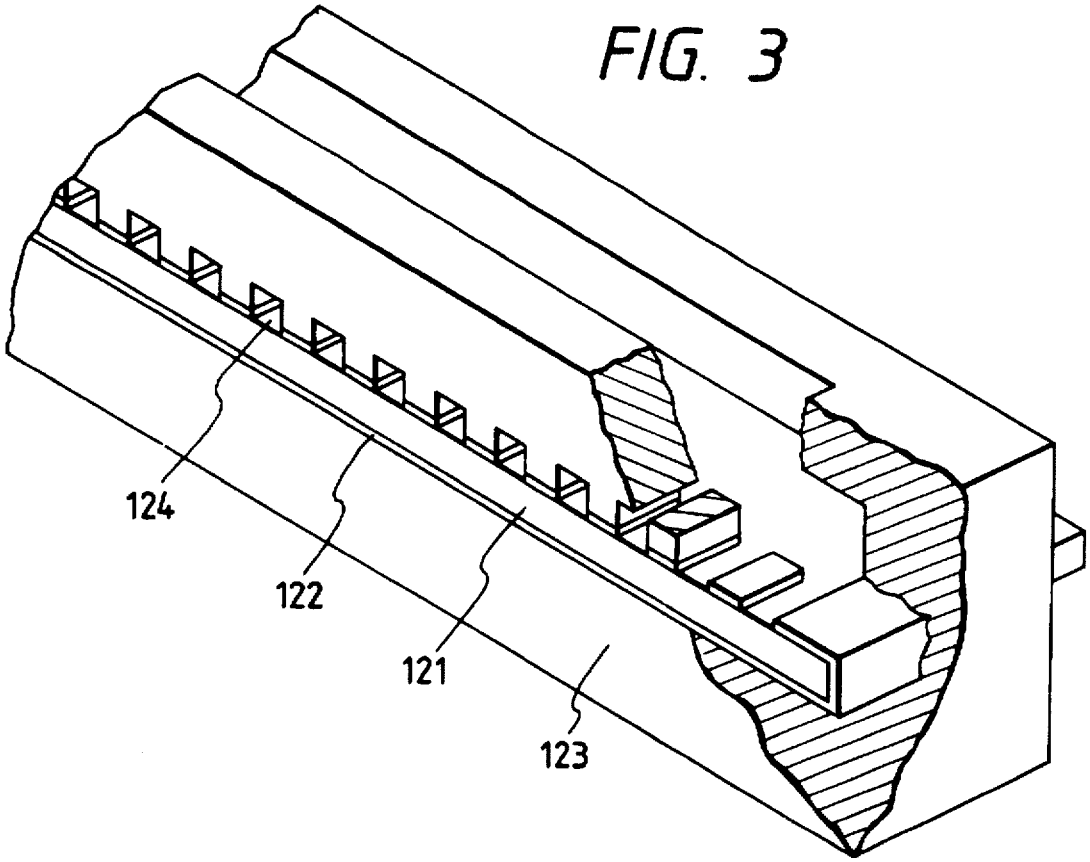
FIG. 3 is a schematic perspective view, partially broken away, showing an ink jet recording head according to a third embodiment of the present invention.
Figure 4:
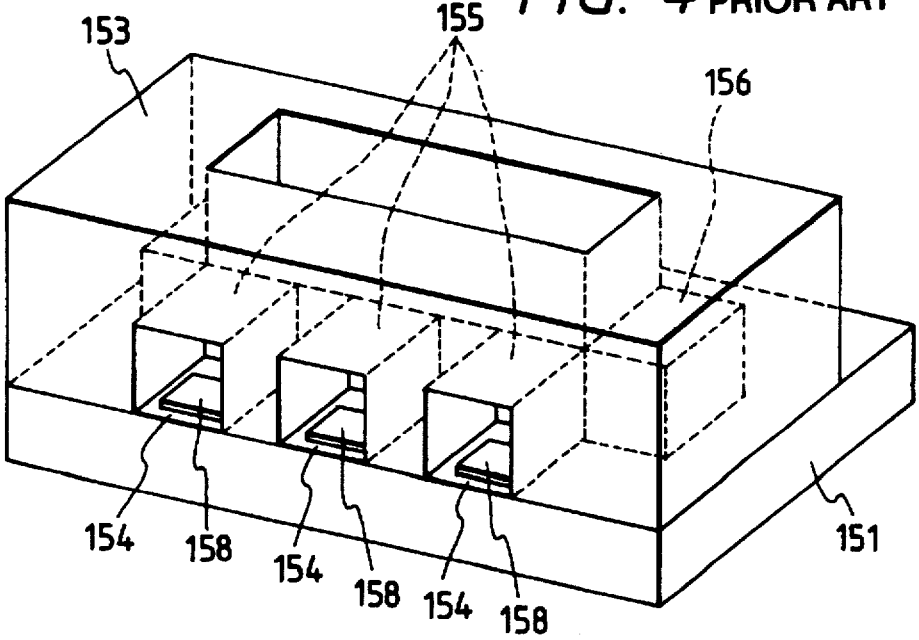
FIG. 4 PRIOR ART
FIG. 4 is a schematic perspective view of a conventional ink jet recording head.

FIG. 3 shows full-line type recording head in which a plurality of discharge ports 124 are formed across an entire width of the recording area of a recording medium. When the length or area of the substrate 121 is large due to the formation of a plurality of discharge ports 124 as in this embodiment, the substrate 21 may be possibly warped due to a stress from the structural member 123, if the structural member 123 is only molded on the element surface of the substrate 121. If the substrate 21 is warped, the ruled line may be skewed in printing, so that the print quality is degraded. To prevent it, the structural member 123 is molded to wrap both faces of the substrate 121, thereby balancing the stress on the substrate 121. Thus, the polyimide resin layer 122 (a layer 2 μm thick of "PIQ" manufactured by Hitachi Chemical) as the adherent layer is provided to wrap both faces of the substrate 121, so that the substrate 121 and the structural member 123 are fused via the polyimide resin layer 122. Other constitutions are the same as in the first embodiment, and the explanation will be omitted.

In this way, when the structural member 123 is molded on both faces of the substrate 121, the adherent layer 121 is provided corresponding to the molding position of the structural member 123, thereby securing the adhesion between the substrate 121 and the structural member 123 and improving the cushioning therebetween.

Also, means for decreasing the stress of the structural member 123 occurring at the molding of the structural member 123 often has a milled filler contained in the structural member 123, but the milled filler may damage the surface of the substrate 121. However, since the substrate 121 and the structural member 123 are fused via the adherent layer, the substrate 121 is protected by the adherent layer so as not to be damaged by the milled filler. Therefore, it is possible to decrease the stress of the structural member 123 more securely by containing the milled filler in the structural member 123. With the decreased stress from the structural member, the warp of the substrate 121 is suppressed, thereby leading to the improvement of the print quality.

Figure 12:
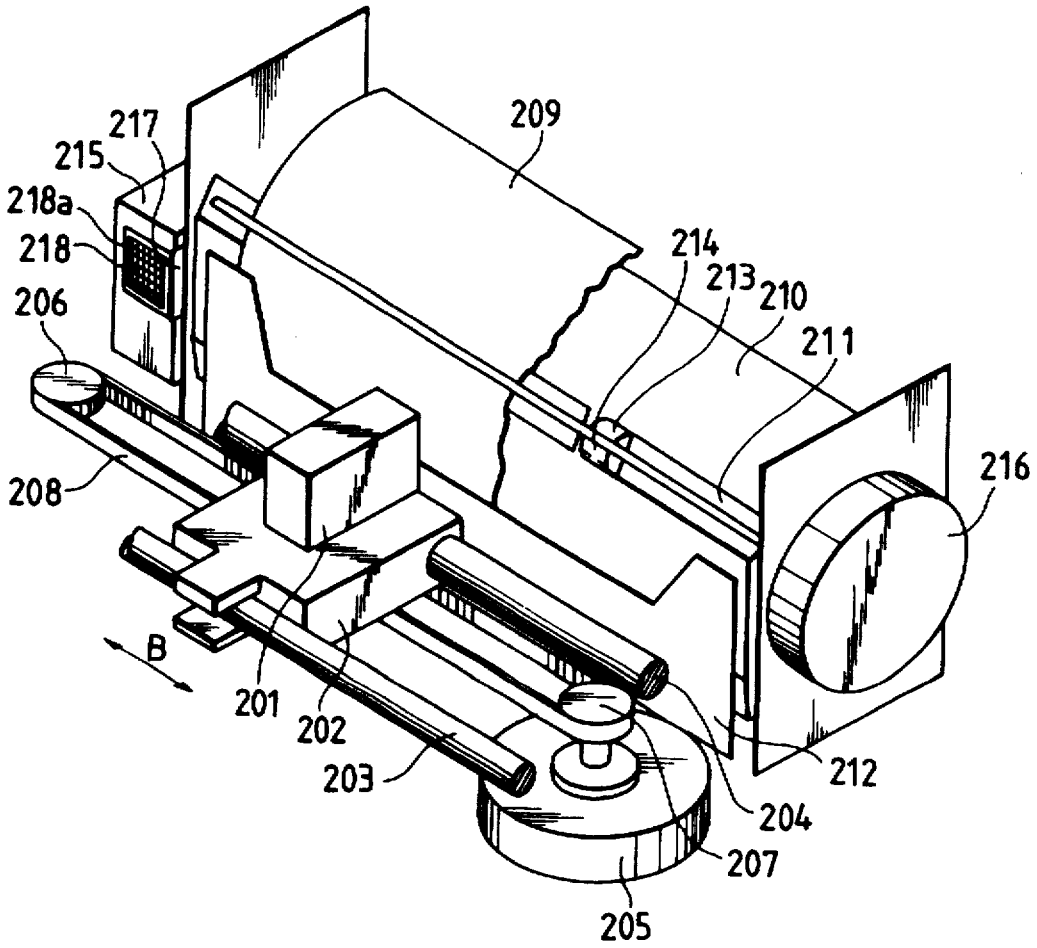
FIG. 12 is a schematic perspective view showing essential parts of an ink jet recording apparatus with an ink jet head mounted.

FIG. 12 is a perspective view showing schematically an external constitution of an ink jet recording apparatus with an ink jet head mounted thereon according to the present invention. In FIG. 12, 201 is an ink jet recording head (thereinafter referred to as a recording head) for recording a desired image by discharging the ink based on a predetermined recording signal, and 202 is a carriage movable by scanning in a direction of the recording line (a main scan direction) with the recording head 201 mounted thereon. The carriage 202 is slidably supported by guide shafts 203, 204, and moves reciprocatingly in the main scan direction along with the movement of a timing belt 208. The timing belt 208 engaging with pulleys 206, 207 is driven via a pulley 207 by a carriage motor 205.

A recording paper 209 is guided by a paper pan, and conveyed by a paper feed roller (not shown) which is compressed by a pinch roller. This conveyance is carried out by a paper feed motor 216 as the driving source. The recording sheet to be conveyed is tensioned by a paper exhaust roller 213 and a spur 214, and pressed against a heater 211 by a paper presser plate 212 formed of an elastic material so as to be conveyed in close contact with the heater. The recording paper 209 onto which the ink jetted from the head sticks is heated by the heater 211, and sticking ink is fixed onto the recording sheet 209 with its water content evaporated.

215 is a unit called a recovery system which serves to maintain the discharge characteristics in a normal state by removing foreign matters adhering to discharge ports (not shown) of the recording head 201 or thickened ink. **218*a* is a cap constituting a part of the recovery system unit 215 to cap the discharge ports of the ink jet recording head 201 and prevent the occurrence of clogging. Inside the cap 218*a* is disposed an ink absorbing member 218**.

On the recording area side of the recovery system 215 is provided a cleaning blade 217 in contact with a face having the discharge ports of the recording head 201 formed thereon to clean away foreign matters or ink droplets adhering to the discharge orifice face.

The present invention brings about excellent effects particularly in a recording head or a recording device of the system of discharging the ink by the use of the heat energy among the ink jet recording methods.

It is preferable to employ the typical structure and the principle of structures disclosed in, for example, U.S. Pat. No. 4,723,129 and U.S. Pat. No. 4,740,796. This system can be adopted in a so-called "On-Demand" type and "Continuous" type structures. In this system, an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nuclear boiling point, so that thermal energy is generated in the electrothermal conversion member and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge port, so that at least one droplet is formed. In a case where the aforesaid drive signal is made to be a pulse signal, a further satisfactory effect can be obtained in that the bubble can immediately and properly be enlarged/contracted and liquid (ink) can be discharged while exhibiting excellent responsibility. It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U.S. Pat. No. 4,558,333 and U.S. Pat. No. 4,459,600 in which the headed portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Application Laid-Open No. 59-123670 and a structure in which an opening for absorbing thermal energy pressure wave is formed to align to the discharge port and which is disclosed in Japanese Patent Application Laid-Open No. 59-138461.

A full line type recording head having a length which corresponds to the width of the maximum recording medium which can be recorded by the recording apparatus may be a structure capable of realizing the aforesaid length and formed by combining a plurality of recording heads as disclosed in the aforesaid specifications or a structure formed by an integrally formed recording head. The present invention will enable the aforesaid effects to be exhibited further effectively.

In addition, the present invention can also be effectively adapted to a structure having an interchangeable chip type recording head which can be electrically connected to the body of the apparatus or to which ink can be supplied from the body of the apparatus when it is mounted on the body of the apparatus or a cartridge type recording head integrally formed to the recording head.

Also, addition of a restoration means for the recording means, a preliminary auxiliary means, etc. provided as the constitution of the recording device is preferable because the effects of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the ink jet recording device, the present invention is extremely effective for not only the recording head only of a primary color such as black, etc., but also a device equipped with at least one of plural different colors or full color by color mixing, whether the recording head may be either integrally constituted or combined in plural number.

Though the ink is considered as the liquid in the embodiments of the present invention as above described, the present invention is applicable to either of the ink solid below room temperature, and softening or liquefying at or above room temperature, or the ink liquefying when a recording enable signal is issued as it is common with the ink jet recording device to control the viscosity of ink to be maintained within a certain range of the stable discharge by adjusting the temperature of ink in a range from 30° to 70° C. In addition, in order to avoid the temperature elevation due to the heat energy by positively utilizing the heat energy for the change of state from solid to liquid, or to prevent the ink from evaporating by the use of the ink stiffening in the shelf state, the ink having a property of liquefying only with the application of heat energy, such as the ink liquefying with the application of heat energy in accordance with a recording signal so that liquid ink is discharged, or the ink already solidifying upon reaching a recording medium, is also applicable in the present invention. In this case, the ink may be in the form of being held in recesses or through holes of porous sheet as liquid or solid matter, and opposed to electricity-heat converters, as described in Japanese Patent Application Laid-Open No. 54-56847 or Japanese Patent Application Laid-Open No. 60-71260. The most effective method for inks as above described in the present invention is based on the film boiling.

The present invention thus constituted can exhibit the following effects.

Since the substrate and the structural member are fused via the adherent layer, the adhesion between the substrate and the structural member is improved, so that it is possible to decrease the exfoliation of the structural member from the substrate which may occur in making the transfer molding of the structural member on the substrate.

Also, when a plurality of recording heads which are integrally formed are cut off into individual recording heads at predetermined positions, the vibration at the cutting can be absorbed into the adherent layer due to the cushioning of the adherent layer so that the occurrence of cracks on the substrate due to that vibration decreases.

Further, since the boundary surface between the structural member and the substrate is protected by the adhesion surface, it is possible to contain a milled filler in the structural member in order to decrease the stress on the structural member occurring when the structural member is molded, whereby the stress on the structural member can be surely decreased to suppress the warp of the substrate, resulting in the improved print quality.

What is claimed is:

1. A method for manufacturing an ink jet head having a discharge opening for discharging an ink therefrom, a liquid chamber for holding the ink to be supplied to the discharge opening, a liquid path for communicating the discharge opening with the liquid chamber, and an energy generation element disposed in the liquid chamber for generating an energy used to discharge the ink, comprising the steps of:

preparing a substrate provided with the energy generation element;

forming a polyimide layer at least on a whole area on the substrate where a wall of the liquid path and the liquid chamber are to be formed;

forming a soluble solid layer having a liquid path pattern on an area on the substrate where the liquid path and the liquid chamber are to be formed;

forming a space by using a mold for molding on the substrate on which the solid soluble layer and the polyimide layer are provided;

pouring a resin material whose melting point is lower than that of a material to be formed into the solid soluble layer into the space in a melted state, for forming a portion to be formed into the wall of the liquid path and the liquid chamber on the substrate via the polyimide layer;

removing the mold cutting a liquid path area of the substrate where the wall to be formed into the liquid path and the liquid chamber is provided; and dissolving and removing the solid layer for forming the liquid path and the liquid chamber and forming the discharge opening at a cut portion in the liquid path cut in said cutting step.

2. A manufacturing method according to claim 1, wherein the polyimide layer has a thickness of between 1–3 μm.

3. A manufacturing method according to claim 1, wherein the solid soluble layer is formed by patterning a photosensitive resin.

4. A manufacturing method according to claim 1, wherein a crush-type filler is mixed into the resin material whose melting point is lower than that of the material to be formed into the solid soluble layer.

* * * * *

UNITED STATES PATENT AND TRADEMARK OFFICE

CERTIFICATE OF CORRECTION

PATENT NO. : 5,760,803

DATED : June 2, 1998

INVENTOR(S) : HISASHI YAMAMOTO, ET AL.

It is certified that error appears in the above-identified patent and that said Letters Patent is hereby corrected as shown below:

On the title page, item [54] and column 1, line 1-5:

"INK JET RECORDING TRANSFER MOLDING PROCESSES FOR FORMING AN INK JET RECORDING HEAD AND A RECORDING APPARATUS USING THE HEADS" should read --TRANSFER MOLDING PROCESSES FOR FORMING AN INK JET RECORDING HEAD AND A RECORDING APPARATUS USING THE HEAD--

Signed and Sealed this

Sixteenth Day of March, 1999

*Attest:*

*Attesting Officer*

Q. TODD DICKINSON

*Acting Commissioner of Patents and Trademarks*